US007794173B2

(12) United States Patent
Amengual Pericas

(10) Patent No.: US 7,794,173 B2
(45) Date of Patent: Sep. 14, 2010

(54) DEFORMABLE DIVIDER FOR A VEHICLE IMPACT SAFETY BARRIER, OF THE TYPE THAT IS USED BETWEEN A VERTICAL SUPPORT-OR POST-FIXING ELEMENT AND A HORIZONTAL IMPACT OR RAILING ELEMENT

(75) Inventor: Antonio Amengual Pericas, Asturias (ES)

(73) Assignee: Hierros y Aplanaciones, S.A., Corvera. Asturias (ES)

( * ) Notice: Subject to any disclaimer, the term of this patent is extended or adjusted under 35 U.S.C. 154(b) by 363 days.

(21) Appl. No.: 11/910,910

(22) PCT Filed: Nov. 22, 2005

(86) PCT No.: PCT/ES2005/000634

§ 371 (c)(1), (2), (4) Date: Oct. 5, 2007

(87) PCT Pub. No.: WO2006/106159

PCT Pub. Date: Oct. 12, 2006

(65) Prior Publication Data

US 2009/0279950 A1 Nov. 12, 2009

(30) Foreign Application Priority Data

Apr. 7, 2005 (ES) ..... 200500805

(51) Int. Cl.
*E01F 9/00* (2006.01)

(52) U.S. Cl. ..... 404/6; 404/10; 256/13.1

(58) Field of Classification Search ..... 404/6, 404/9, 10; 256/13.1
See application file for complete search history.

(56) References Cited

U.S. PATENT DOCUMENTS

| | | | | | |
|---|---|---|---|---|---|
| 3,284,054 | A | * | 11/1966 | St Pierre | 256/13.1 |
| 3,417,965 | A | * | 12/1968 | Gray | 256/13.1 |
| 3,438,611 | A | * | 4/1969 | Vittorio et al. | 256/13.1 |
| 3,589,681 | A | * | 6/1971 | Ackerman | 256/13.1 |
| 5,044,609 | A | * | 9/1991 | Cicinnati et al. | 256/13.1 |
| 5,227,516 | A | * | 7/1993 | Tohzuka et al. | 560/182 |
| 5,689,918 | A | * | 11/1997 | Johnson | 52/153 |
| 6,065,894 | A | * | 5/2000 | Wasson et al. | 403/2 |

(Continued)

OTHER PUBLICATIONS

WIPO, International Search Report for PCT/ES2005/000634.

*Primary Examiner*—Raymond W Addie
(74) *Attorney, Agent, or Firm*—Intellectual Property Law Group LLP; Juneko Jackson; Otto O. Lee

(57) ABSTRACT

Deformable separator device for road safety barrier for vehicle impact of the type used between a vertical securing-support element or post and a horizontal impact element or railing, characterized in that the deformable separator (3) comprises two metallic pieces (5) and (6), in the form of a "U", which are arranged so that their open faces are facing each other, assembled forming a single body, and with one piece being partially contained within the throat of the other piece and joined together by means of suitable fastening means via individual holes and in that the wings of the pieces are provided with guide-holes (11) (11') at different heights in such a manner that they guide the bending of the separator element and which comprises a fusible fastening between the separator element and the post.

11 Claims, 8 Drawing Sheets

U.S. PATENT DOCUMENTS 6,644,888 B2 * 11/2003 Ochoa ..... 404/6
2004/0079932 A1 * 4/2004 Hanai et al. ..... 256/13.1
2004/0139686 A1 * 7/2004 Bernard ..... 52/736.1
2008/0265231 A1 * 10/2008 King ..... 256/13.1

* cited by examiner

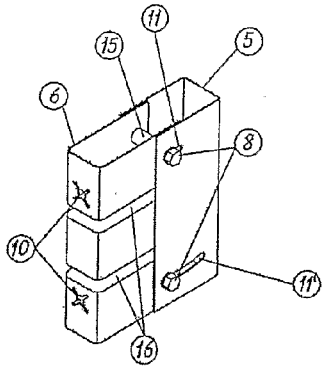
FIG.4A
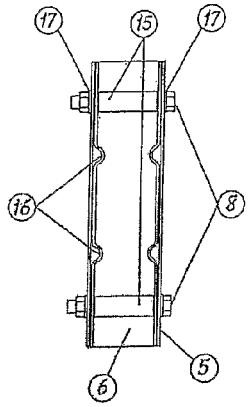
FIG.4B
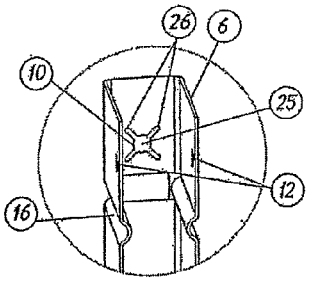
FIG.4D
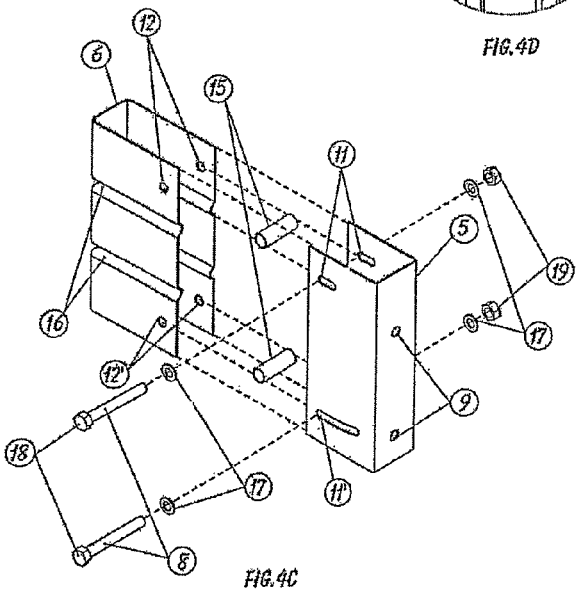
FIG.4C
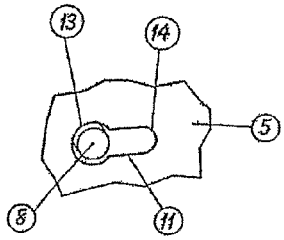
FIG.4E
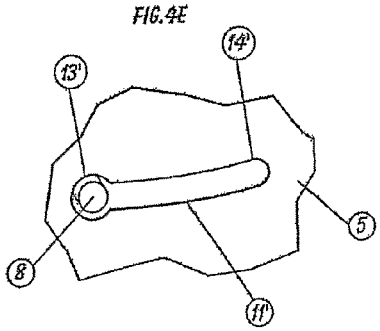
FIG.4F
FIG.4

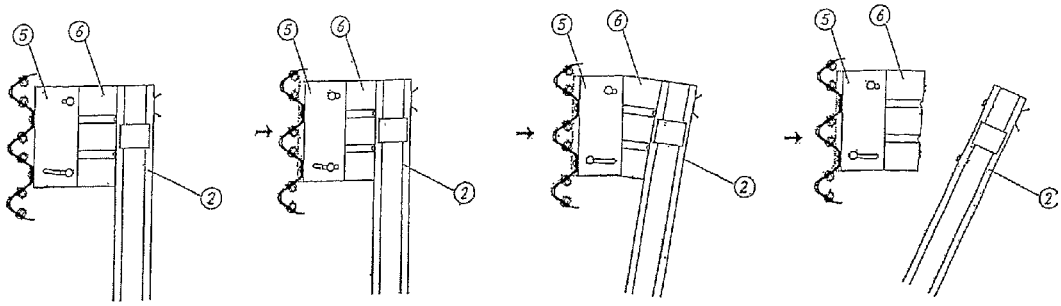
FIG.5A FIG.5B FIG.5C FIG.5D
FIG.5
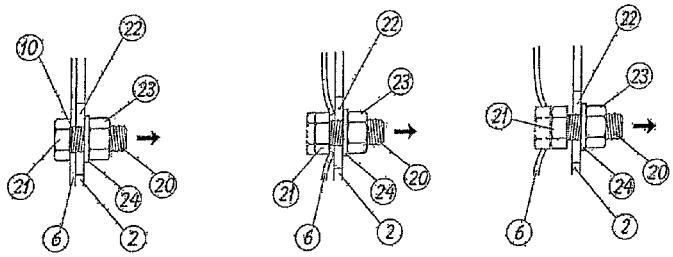
FIG.6A FIG.6B FIG.6C
FIG.6

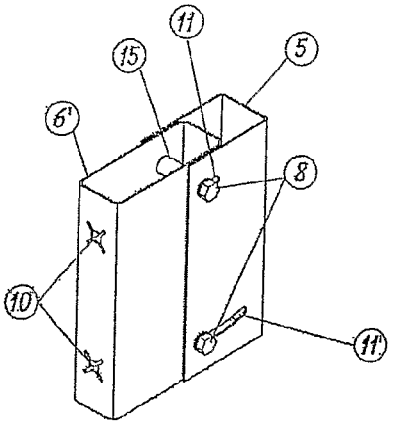
FIG.12A
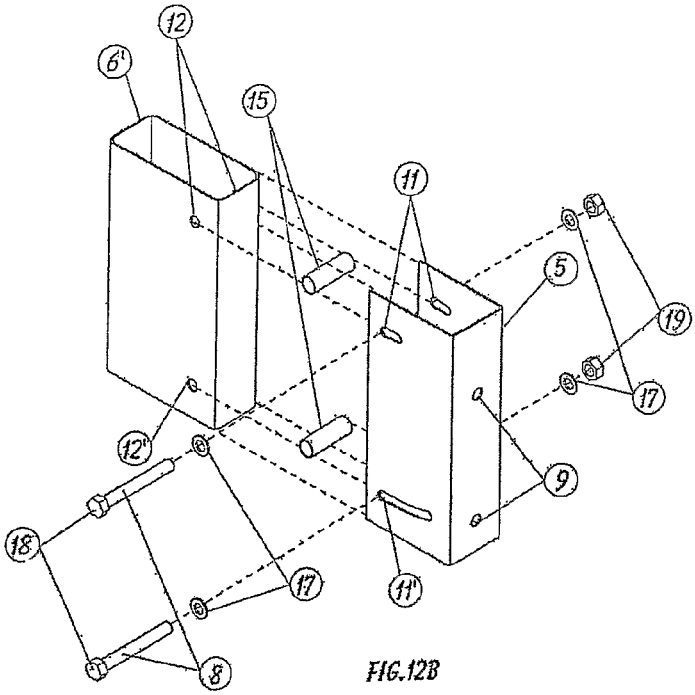
FIG.12B
FIG.12

DEFORMABLE DIVIDER FOR A VEHICLE IMPACT SAFETY BARRIER, OF THE TYPE THAT IS USED BETWEEN A VERTICAL SUPPORT-OR POST-FIXING ELEMENT AND A HORIZONTAL IMPACT OR RAILING ELEMENT

OBJECT OF THE INVENTION

The present invention refers to a deformable separator device, which functions interposed between the horizontal fences or railings and the vertical support post of a containment system for lateral impact by vehicles with a high capacity for containment, redirecting and absorption of energy, for use in road safety equipment, such as safety barriers, having widespread use on the sides of embankments and on the central reservation of roads and, occasionally, on the sides of the deck of a road bridge.

STATE OF THE ART

In practice there exist various kinds of vehicle containment systems, these being understood as any device installed on a road with the purpose of providing retention and redirection of a vehicle which comes off the road out of control, thereby reducing the severity of the accidents produced, in such a way that the damages and injuries are limited, both for the occupants and for other road users and other persons or objects located in the vicinity.

Two of the commercially most usual containment systems are metallic safety barriers, used on the sides and on the central reservation of roads, and metallic parapets, which are similar to safety barriers but specifically designed for the sides of decks for crossing structures (bridges, viaducts, etc.), the coping of support walls and similar works. These elements have the purpose of resisting vehicle impacts, stopping from them passing through and thereby guaranteeing the protection of third parties and proceeding to redirect the vehicle and carry out its controlled deceleration, in such a way that the vehicle exits from the impact stably and continues to travel at a reduced speed along the containment system in the original direction of the traffic, in this way guaranteeing the safety of the occupants of the vehicle and other road users.

According to the existing applicable standard (EN 1317-2 in Europe and NCHRP 350 in the USA), before coming into commercial use, safety barriers and metallic parapets are subjected to certain standardised collision tests at the real scale in which an impact is carried out in a controlled manner between a standard vehicle and a containment system, permitting the behaviour of that system to be evaluated qualitatively and quantitatively. A containment system satisfactorily passes a real scale collision test when it complies with the requisites and criteria for acceptance defined in the standard in terms of containment level, severity of the impact, deformation and angle of exit, and therefore guarantees certain adequate conditions of safety, primarily for the occupants of the vehicle and for third parties. It is then stated that a containment system has the capacity for containing a certain standard vehicle.

According to the said standard, a high containment system (designed specifically for receiving the shock of heavy vehicles such as lorries and coaches) has to support real scale collision tests both of heavy vehicles (lorries and coaches) and of light vehicles (automobiles). This permits high containment systems to also guarantee the safety of light vehicles, which constitute the most frequent type of accident. For example, according to European standard EN 1317-2, the level of high containment H2 requires passing test TB51 (impact of a coach of weight 13,000 kg at a speed of 70 km/h, and with a collision angle against the containment system of 20°).

In practice, commercial containment systems present a range of solutions for acting in the event of an impact from both light and heavy vehicles and they display the following problems:

On the one hand, in safety barriers all the constituent elements in general have the capacity to react in a similar way and, as a whole, by means of deformation, in the event of an impact from both a light and a heavy vehicle. Safety barriers designed to withstand impacts from heavy vehicles (high containment) in general present functioning mechanisms that are capable of responding with a different behaviour towards a light vehicle compared to a heavy one. The success in the design of such barriers consists precisely in the commitment to achieve a good behaviour towards two such different types of impact with the same barrier.

Metallic safety barriers consist of the joining of three basic elements and a fourth optional one:

1. The fence(s) or railing(s), longitudinal elements horizontally arranged in one or several levels at a defined height and continuously, whose function is that of containing and guiding the vehicle impacting against it, preventing it from passing through, limiting the transverse deformation and guiding it in such a way that it can be redirected by the system in an appropriate manner. The fence can present different designs: one or several longitudinal profiles of open or semi-closed cross-section, in the form of a double or triple wave or in the form of a "C" or of a "sigma", joined to the post by means of a separator element; cables or metallic rods tensed and secured directly to the post; longitudinal profiles in the form of a double or triple wave joined in their upper part to metallic sheets with capacity for free movement and calibrated for putting up a certain resistance in the event of an impact.

2. The post arranged vertically at regular intervals and secured to the fence(s) or railing(s), whose function is to support and keep the fence(s) or railing(s) of the barrier at a certain height during impact. The posts are generally metallic profiles of cross-section in the form of a "C", a "U", an "I", a "sigma" a "Z", closed round or rectangular tubular cross-sections or other type of cross-section, which are inserted in an embankment or central reservation of a road in such a way that part of its length is embedded in the ground or via a plate with anchor bolts inserted in the ground. In the event of an impact with a vehicle, and depending on the energy of that vehicle, the post is deformed to a greater or lesser degree being bent and/or twisted with regard to the embedded or anchored section.

3. The separator element is the intermediate piece for connection between a fence or railing and the post, whose function is that of:

(I) joining the fence or railing to the fastening posts at a certain height, (II) acting as a distancing element between that fence or railing and the post in order to prevent the wheel of the vehicle becoming caught in the post during impact against the barrier, and (III) attenuating or absorbing part of the energy of the impact and helping to redirect the vehicle during the impact. In this latter case, the separator is given the name of energy absorber. The absorbing function of the separator is characteristic of high containment barriers since such barriers present a very robust and rigid basic structure, consisting of the fence or fences and some robust posts provided at a short distance capable of containing heavy vehicles and, therefore, said structure is too rigid for the impact of light vehicles. The separator-absorber is specifically designed to reduce the severity of the impact of light vehicles against these rigid basic structures, cushioning the contact with the post and helping to redirect the vehicle. On some occasions, this element consists of a single component or a unit that is assembled from metallic bars and/or profiles shaped in a manner that is to a greater or lesser degree complex, or it consists of tubular profiles of quadrangular or rectangular cross-section, open or closed. On other occasions, we can find barriers in which there does not exist any separator or absorber, and the fence is fastened directly to the post. In other situations, above all on roads belonging to motor racing circuits, it is possible to find other arrangements in which the absorber or separator element consists of cylinders of a resistant elastic material filled with foam or similar material located between the fences and the post or external wall, or even consisting of a metallic structure of a triangular semi-truss shape which simultaneously acts as absorber and post, permitting the barrier to be displaced in the event of impact. The energy absorption capacity of a safety barrier is sometimes achieved by means of elastic adapters by way of a casing placed on the fences or railings.

4. A horizontal continuous rear brace longitudinally connecting the posts of the barrier via the rear part thereof, either joining consecutive posts via their upper head or consecutive separators via their lower part. The brace has the function of (I) distributing the stresses originated by the impact among several posts in order to reduce the transverse deformation of the barrier and (II) compensating and limiting the torsion stresses in the head of the posts.

DESCRIPTION OF THE INVENTION

The present invention provides a high performance separator-absorber device which is integrated into a containment system for side impacts from vehicles, having a high capacity for containment and energy absorption, along with certain innovative and specific characteristics of the post and of the rear brace which are necessary and are combined together in order to achieve the technical advantages which the separator-absorber device contributes to the functioning of the safety barrier with regard to the State of the Art, in order to overcome the problems originated by the impact against a containment system of a vehicle which leaves the carriageway in an uncontrolled manner:

(i) high capacity for absorption of the energy resulting from the impact of a vehicle, whether this vehicle is light or heavy, in order to provide the containment system with an elasto-plastic behaviour and thereby diminish its rigidity, in order to prevent the containment system from causing damage equal to or worse than that from which it is wished to protect the users;

(ii) high capacity for achieving a reduction in the deceleration levels produced in a light vehicle during impact, in order to lessen the severity of the impact and thereby the risk of injuries for the vehicle occupants;

(iii) high capacity for control of the trajectory and stability of the vehicle during and after the collision, in order to therefore reduce the possibility of subsequent undesired reactions thereof (spinning, overturning, unexpected trajectories, etc.) and also achieve an exit trajectory that is as parallel as possible to the containment system, reducing the risk of secondary collisions with other road users;

(iv) high capacity for controlling the dissipation of the absorbed energy, especially with heavy vehicles, in order to provide the containment system with a certain power to deform itself similarly after each impact with a vehicle and thereby contribute to extending the useful life of the rest of the elements making up the containment system.

For this and with the aim of achieving the above advantages with regard to the State of the Art, it has been necessary to design a novel system of deformable separator-absorber for containment of vehicle impacts combined into a vehicle containment system, which incorporates the following as novelties:

The deformable separator (3) of the invention described below is combined into a safety barrier comprised of one or several continuous horizontal fences or railings (1) and (1') or of any other horizontal impact element, supported via the separator (3) by vertical fastening elements or vertical posts (2) inserted into the ground (7) at regular intervals and a horizontal continuous rear brace (4) which is connected to the post (2) via its rear part.

The deformable separator (3) is basically composed of two metallic pieces (5) and (6), both with a U-shaped cross-section, each with a central face or spine and two lateral faces or wings parallel to each other and perpendicular to the central face and with two straight folds, sharp or with rounded edge, between the central face and each of the lateral faces, the relative position of the two U-shaped pieces (5) and (6) being such that the longitudinal axes of both are parallel or appreciably parallel to each other and are arranged vertically or with a slight inclination. The two U-shaped pieces are assembled to form a single body in such a way that the open parts or "throats" of each U-piece have different widths and are facing each other, with one U-piece remaining partially contained within the "throat" of the other U-piece, with the lateral faces of both pieces being very close to each other or in direct contact end to end two by two and the pieces being joined together by means of bolts (8) which successively traverse their lateral faces perpendicularly to their longitudinal axis.

One of the U-shaped pieces (5) is fixed, preferably by means of one or several bolts which traverse one or several holes (9) in its central face, which is what forms the core or "spine" of the piece, to the horizontal railing(s) or fence(s) (1) and (1') of the barrier and therefore occupies a forward position (relative to the direction of the traffic) in the separator (3). The other U-piece (6) is fixed, preferably by means of one or several bolts which traverse holes (10) in its central face, which is what forms the core or "spine" of the U-piece, to the post (2) of the safety barrier and therefore occupies a rear position in the separator (3).

Preferably, it is the "throat" of the forward U-piece (5) which externally embraces the "throat" of the rear U-piece (6).

The bolts (8) joining the two U-pieces (5) and (6) to each other do so by successively traversing holes (11), (11'), (12) and (12') made for the purpose in the lateral faces of the two U-pieces. The holes (11) and (11') which have been made for the purpose in both lateral faces of one of the U-pieces, preferably the one occupying the forward position (5), have a shape in the form of a closing grommet or eyelet (11) and (11') with a rear cavity that is rounded or similar (13) and (13') of diameter or size greater than the diameter of the shaft of the bolt (8) and a forward elongated cavity (14) and (14') connected to the rear one (13) and (13') and of width less than the diameter of the shaft of the bolt (8), said cavity being able to be straight or curved and preferably with a straight section linked in the round cavity and a curved section forward of the straight section. Each lateral face of this forward U-piece (5) can have two or more holes in the form of a closing grommet or eyelet (11) and (11') located at different heights. The length of the elongated cavity section is preferably greater to the degree that the hole corresponds to a lower position according to the vertical or slightly inclined longitudinal axis of the U-piece.

The holes (12) and (12') made in the lateral faces of the other U-shaped piece, preferably the rear one (6), have a circular or rounded shape of diameter greater than the diameter of the shaft of the union bolt.

The arrangement of the holes (11), (11'), (12) and (12') in each lateral face of the two U-pieces (5) and (6) is such that to each hole of one lateral face there corresponds another symmetric one according to the plane parallel to the lateral faces which contains the longitudinal axis of the U-piece located in the other lateral face thereof. The union between the two U-pieces made in this way permits them to be capable of being partially displaced one with respect to the other by translation in a vertical plane with one being maintained inside the other over the course of a certain distance and, thanks to the curved section of the forward section of the holes forming the closing grommets or eyelets of the lateral faces of one of them, they are also capable of rotating one with respect to the other around the axis defined by the union bolts. The length of the curved section of the elongated cavity of the hole in the form of a closing grommet or eyelet is greater to the degree that the position of the hole is lower according to the longitudinal axis of the U-piece, and this allows the angle of rotation of one piece with respect to the other to increase.

The fact that the width of the forward cavity (14) and (14') of the hole in the form of a closing grommet or eyelet (11) and (11') of the forward U-piece (5) is less than the diameter of the shaft of the bolt (8) means that, during the relative displacement of one piece (6) within the other (5), the shaft of the bolt (8) deforms the walls of the elongated cavity (14) and (14') of the hole in the form of a closing grommet or eyelet (11) and (11') and, with it, there appears a progressive resistance to the sliding of the shaft of the bolt (8) within the hole (11) and (11') which permits both the translation movement and the rotation of one U-piece (5) with respect to the other U-piece (6) to be controlled, with one U-piece (6) being maintained partially within the other U-piece (5).

In order to guarantee the rigidity of the set of two U-pieces (5) and (6) making up the separator (3) and, in turn, permit movement of one of them inside the other, tubes (15) are provided, preferably metallic and of circular cross-section, circumscribed around the shaft of each union bolt (8) between the U-pieces, "sheathing" it, the length of which is slightly less than the distance between the interior side walls of the U-piece (6) fixed to the post or the rear. These tubes (15) exert a separating function between the walls in the manner of the interior U-piece (6) which, once the union bolts (8) have been placed and tightened, maintains the interior distance between the lateral faces of the rear U-piece (6), making it possible so that, during the impact of the vehicles, said U-piece (6) behaves as a rigid body, resistant to deformation by twisting, as if it were a tube of rectangular cross-section.

Also with the aim of the rear U-piece (6) attached to the post (2) being more rigid and resistant to twisting relative to the vertical axis, one or more ribs (16) are provided, orientated preferably towards the interior of the U-piece (6) and contained within a plane, preferably horizontal or slightly inclined, perpendicular to the longitudinal axis thereof, along the entire or a large part of the perimeter of the U-section of the rear piece (6).

In order to facilitate movement of one U-piece (5) with respect to the other (6) when the shaft of the bolt (8) is displaced via the hole in the form of a grommet (11) and (11'), washers (17) are provided, preferably circular, below the head (18) and the nut (19) of the bolt (8), in contact with the surfaces of both lateral faces of the forward U-piece (5), respectively.

An alternative design of the separator consists of replacing the rear U-piece (6) with a tube of quadrangular or rectangular cross-section (6') whose axis is vertical or slightly inclined, with everything described above being valid in relation to the holes for the lateral faces of the tube which would correspond to the lateral faces of the rear u-piece (6) and for the rear face of the tube which would correspond to the central face of the rear U-piece (6), as is that described for the mechanism enabling relative displacement between the forward U-piece (5) which, in this case, would embrace the rear tube (6') via its exterior part.

In its central face or core the rear U-piece (6) of the separator is provided with one or several holes (10) in order to permit its union with the post (2) of the barrier. Said unions are preferably of the screwed type, with bolts (20) of preferably hexagonal head (21), though it can also be quadrangular or round, the shaft of which passes successively through the corresponding hole (10) in the rear U-piece (6) and through the hole of the post (22), in such a way that the hexagonal head (21) of the screw remains inside the separator (3) and the corresponding nut (23) and washer (24) in the interior of the post (2). The holes (10) in the central face or "spine" of the rear U-piece (6) present a special contour in the form of a star made up of a central cavity (25), preferably circular or appreciably rounded, from which exit a series of elongated cavities (26) of small width (in other words, much longer than they are wide) and arranged in a radial configuration around the central cavity (25).

The diameter or size of the central cavity (25) of the star-shaped hole (10) is greater than the diameter of the shaft of the bolt (20) but less than the diameter or size of the head (21) of the bolt.

The combination of the use of the bolt (20) with preferably hexagonal head (21) and a star-shaped hole (10) in the central face of the rear U-piece (6) of the separator (3) enables a fusible union mechanism to be constructed between the separator (3) and post (2) by means of the bolt (20) which, once tightened, and starting from a certain degree of force acting on the union, permits separation of the separator (3) with respect to the post (2), thanks to the fact that the head (21) of the union bolt (20) can pass through the star-shaped hole (10), bending the metal walls located between the radii (the elongated narrow cavities) (26) of the star-shaped cavity. The result is similar to tearing the immediate surrounds of the star-shaped hole (10) produced by the head (21) or the bolt (20) until that head passes completely through the star-shaped hole and releases that union.

With all the characteristics of the separator described above, an innovative deformable separator is constructed which provides the barrier containing it with excellent performance in the event of impact from vehicles.

The functioning that is achieved with this separator is summarised in the following terms:

(i) In the event of an impact with a light vehicle whose energy does not permit any significant deflection of the post, the stresses transmitted from the vehicle to the railing or fence are transmitted to the separator and this deforms in such way that the forward U-shaped piece is displaced in the transverse direction and in a vertical plane perpendicular to the barrier with respect to the rear U-shaped piece which is fixed to the post. The relative movement between the pieces of the separator is that of displacement by translation first and afterwards rotation as the forward piece moves in relation to the rear one, preferably embracing it via the exterior, with the union bolts joining the two U-pieces being kept fixed and tearing the elongated cavity of the lateral holes of the forward U-piece. The different phases of this relative movement between the U-pieces of the separator in the event of an action transmitted from the fence is shown in FIG. 5 With this movement, a lateral deformation is produced in the barrier of sufficient magnitude for the adequate redirection of the vehicle during and after the impact and with sufficient energy absorption for producing a reduced deceleration in order to diminish the severity of the impact. The energy absorption is controlled by means of tearing the elongated cavities of the holes in the form of a grommet of the lateral faces of one of the U-pieces originated by the shaft of the bolt thanks to the difference existing between the diameter of the shaft of the bolt (greater) and the width of the elongated cavity (smaller).

(ii) In the event of an impact from a heavy vehicle, the separator receiving the stresses of the impact from the fence(s) or railing(s) becomes deformed in the same way as described above but this time the energy of the impact is sufficient for causing the post to rotate through a certain angle in the ground around its embedding therein and become slightly bent, thereby originating a transverse space of deformation which permits the adequate containment and redirection of the heavy vehicle. The rotation of the forward piece of the separator with respect to the rear one, thanks to the unequal length of the curved sections of the elongated cavity of the holes in the lateral faces of the forward U-piece which is greater in the lower holes than in the upper ones, permits the height of the fence(s) or railing(s) to be maintained during the transverse deflection of the post (the post rotates in relation to the point of embedding and bends slightly, all this in a vertical plane perpendicular to the barrier). Nevertheless, the constant maintenance of the height of the fences(s) during the impact thanks to the effect of relative rotation between the parts of the separator is of limited extent and, starting from a certain degree of deflection of the post, the relative rotation between the parts of the separator cannot entirely compensate for the reduction in height due to deflection of the post and, in order to prevent the decrease in the height of the fence(s) or railing(s) from causing the vehicle to overturn or pass through the barrier, it is necessary to release the union between the separator and the post which is done thanks to its fusible nature. FIG. 6 shows the different stages of the "tearing" of the preferably hexagonal head of the union of the separator with the post, via the deformation of the walls of the star-shaped hole(s) in the central face of the rear U-piece.

The release of the fusible union starting from a certain level of stress does not just permit that any decrease in the height of the fence(s) or railing(s) is prevented but also, by decoupling the fence(s)-separator unit from the post, it transmits the stresses deriving from the impact to the adjacent posts, thereby distributing and propagating the deformation along the barrier, which permits it to achieve a high capacity for containment and redirection with which it has been conceived.

The provision of a brace with a certain degree of rigidity also contributes towards distributing the stresses among the posts before the release of the fusible union takes place. Nevertheless, the primary function of the brace is to compensate the torsional stresses in the head of the post generated by the torque produced by the longitudinal component (in the same direction as the barrier) of the force of impact of the vehicle on the fence(s) or railing(s) or the horizontal impact element whose arm is precisely the distance between these latter and the post, in other words, the transverse width of the separator. If there were no rear brace, when the net level of torsional stresses in the head of the post with respect to the embedding exceeds a certain value, the post would become twisted instead of bending, and with that twisting the separator would also twist by an equal or greater degree, which would cause the barrier to lose the capacity to function as has been described above.

However, the characteristics of the deformable separator element (3) that have been described above, and which constitute an innovation on the state of the art, are not in themselves sufficient for fully guaranteeing the behaviour of high containment and redirection with which this type of barrier has been designed. In order for the characteristics of the separator to be translated one hundred percent into the behaviour of the barrier, the barrier in which the separator (3) is combined has to present two specific characteristics which are also innovative:

(a). The post (2) of the barrier, which can have a cross-section in the form of a "C", "U", "sigma" or similar, has two steel plates (27) and (28) rigidly joined to the post, preferably by welding, at the height of the head (27) and in the embedding (28) of the post in the ground, in such a way that each plate, contained in a plane parallel to the core of the post (2), connects with the lateral faces of the profile with a "C", "U", "sigma" or similar shape of the post (2). The upper steel plate (27) has the purpose of preventing excessive deformation of the head of the post (2). The lower plate (28) has the purpose of resisting the tendency to twist in the base of the post and compels the post to rotate and bend transversely maintaining itself in the same vertical plane. During the impact, it is necessary that the stresses of the vehicle which hits the fence(s) or railing(s) (1) and (1') be transmitted solely in a transverse manner to the separators (3) and posts (2) so that the separator (3) deforms in the manner that has been conceived and the fusibility of the separator-post union takes place in the appropriate instant and form.

(b). The rear brace (4) of the barrier, which is fixed to the posts (2) via the rear face of the head thereof and which successively connects with consecutive posts between them, has a trapezoid type profile. This trapezoid profile confers on it a certain resistance to both bending and twisting, which means that the brace (4) can act as a compensator for the major torsion stresses to which the post (2) is subjected in its head during the impact of a heavy vehicle and, in turn, it limits the transverse deformation of the barrier distributing the stresses among consecutive posts until the release takes place of the fusible union between the separator (3) and the posts (2). The consecutive braces (4) are joined together by partial overlapping with a union that is preferably screwed. The overlapping screws (29) and (30) of the brace can also in turn be the union screws (30) between the brace (4) and the rear face of the post (2) via the holes (20) of the head of the post (2).

DESCRIPTION OF THE DRAWINGS

In order to complement the description that is being made and with the aim of aiding a better understanding of the characteristics of the invention, in accordance with a preferred example of practical embodiment thereof, this description is accompanied by a set of drawings in which, on an illustrative rather than limiting basis, the following has been represented:

FIG. 4. Shows different views and details of the separator element:

FIG. 4A. Separator assembled with the two U-pieces with their respective screws and sleeves.

FIG. 4B. Shows a section of the assembled separator.

FIG. 4C. Shows an exploded view of the separator unit.

FIG. 4D. Shows a detail of the separator piece fixed to the post and the fusible hole.

FIGS. 4E and 4F. Show details of the guide-holes.

FIG. 5. Shows a sequence of the behaviour of the separator and the post in the event of a supposed lateral impact.

FIG. 6. Shows a sequence in detail via sub-FIGS. 6A, 6B and 6C of the behaviour of the fusible union between the separator element and the post.

FIG. 12. Shows different views and details of the separator element with one of the pieces of tubular cross-section.

FIG. 12A. Separator assembled with a U-piece and another tubular piece, with their respective screws and sleeves.

FIG. 12B. Shows an exploded view of the separator unit.

EXAMPLE OF EMBODIMENT OF THE INVENTION

Figure 1:
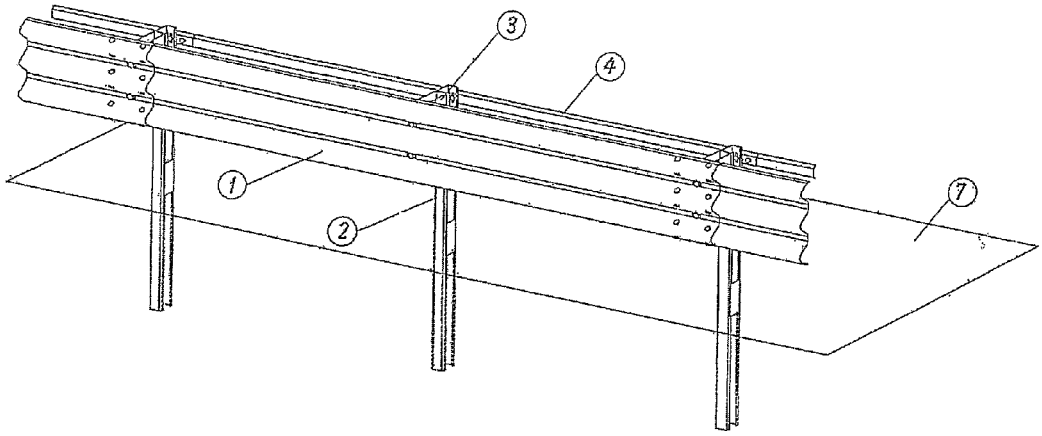
FIG. 1. Shows a front perspective view of the unit in which the arrangement of the barrier can be seen, with fence, separator, post and rear brace.
Figure 2:
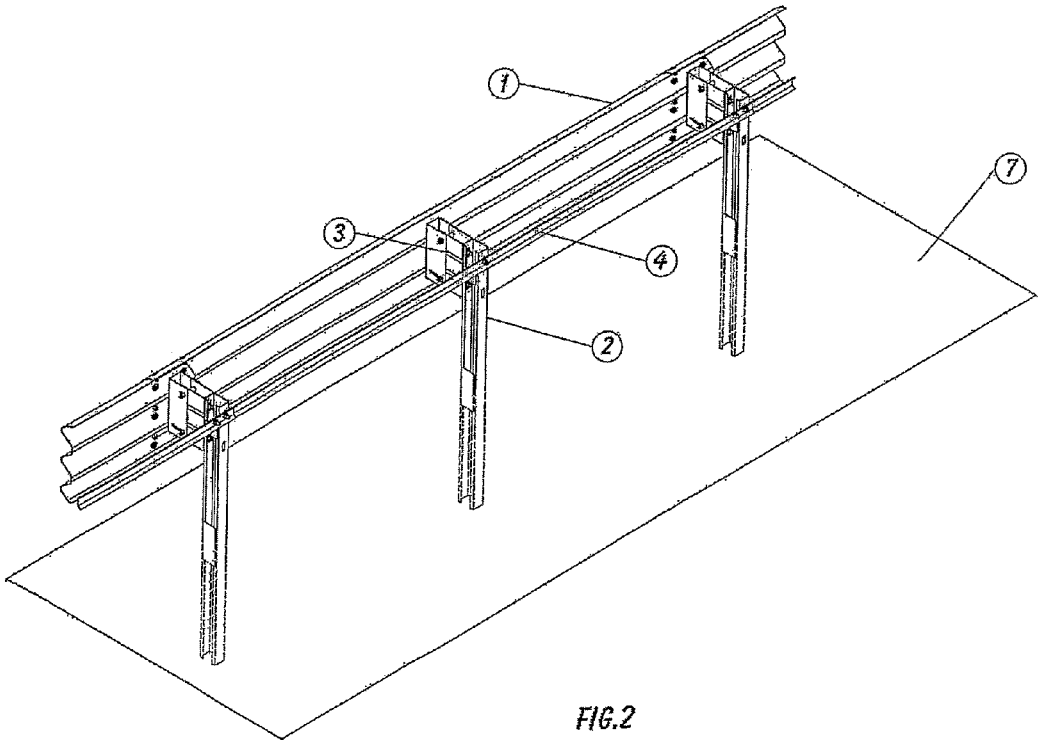
FIG. 2. Shows a rear perspective view of the unit in which the arrangement of the barrier can be seen, with fence, separator, post and rear brace.
Figure 3:
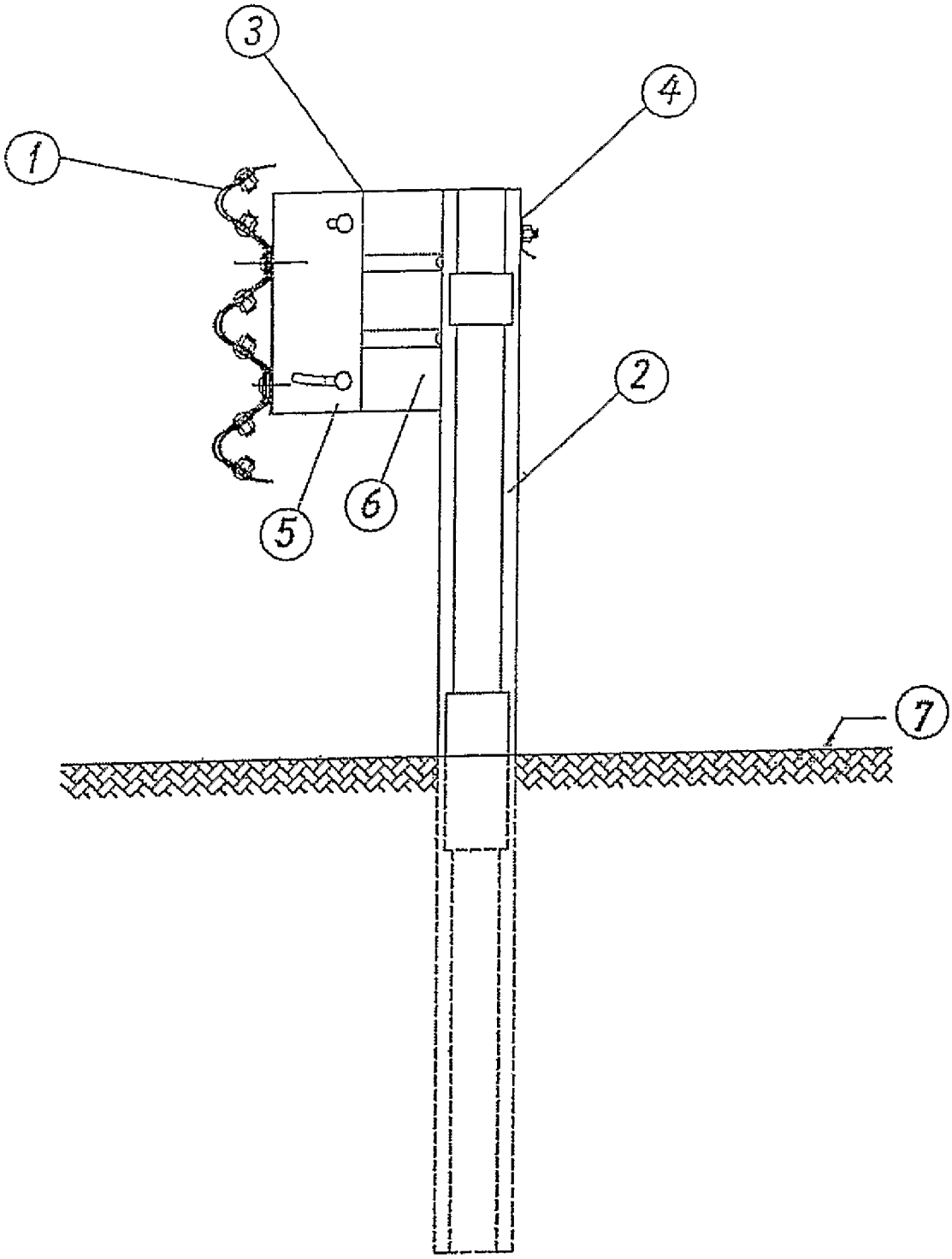
FIG. 3. Shows an elevation view in cross-section of the unit in which the arrangement of the separator can be seen with respect to the fence and the post.
Figure 7:
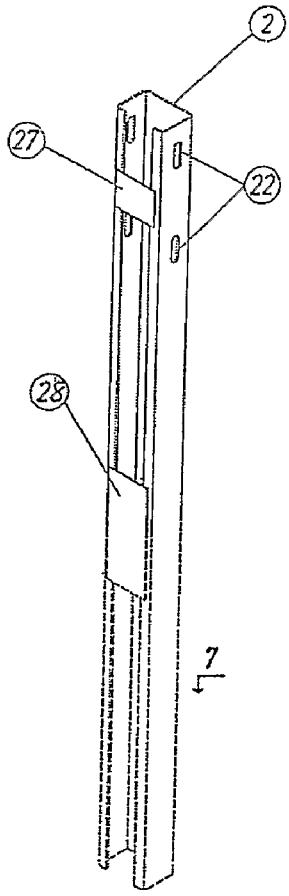
FIG. 7. Shows the arrangement of the plates on the posts.
Figure 8:
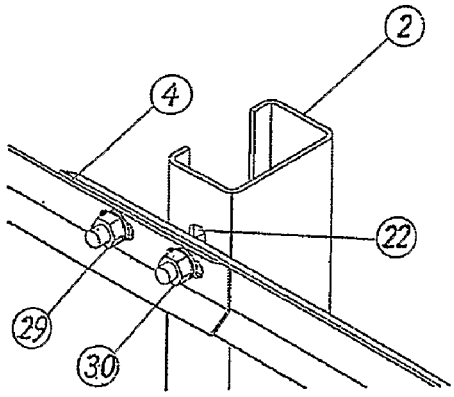
FIG. 8. Shows a perspective view of the trapezoid braces.
Figure 9:
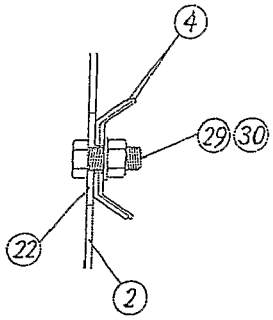
FIG. 9. Shows an elevation view in cross-section of the arrangement of the trapezoid braces.
Figure 10:
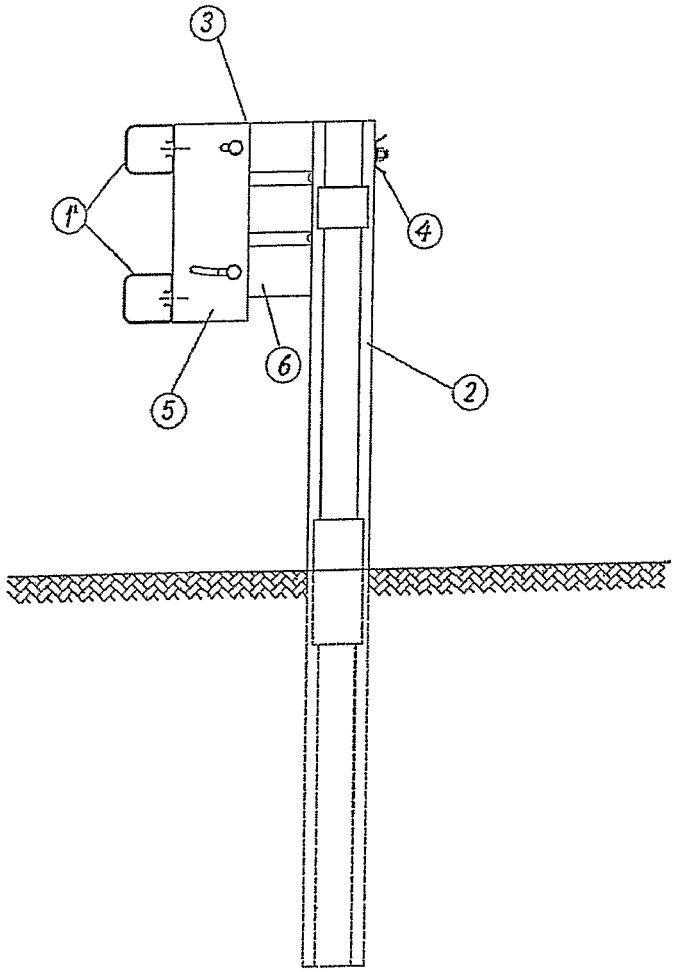
FIG. 10. Shows en elevation view in cross-section of the separator unit in its use with several tubular-type horizontal railings.
Figure 11:
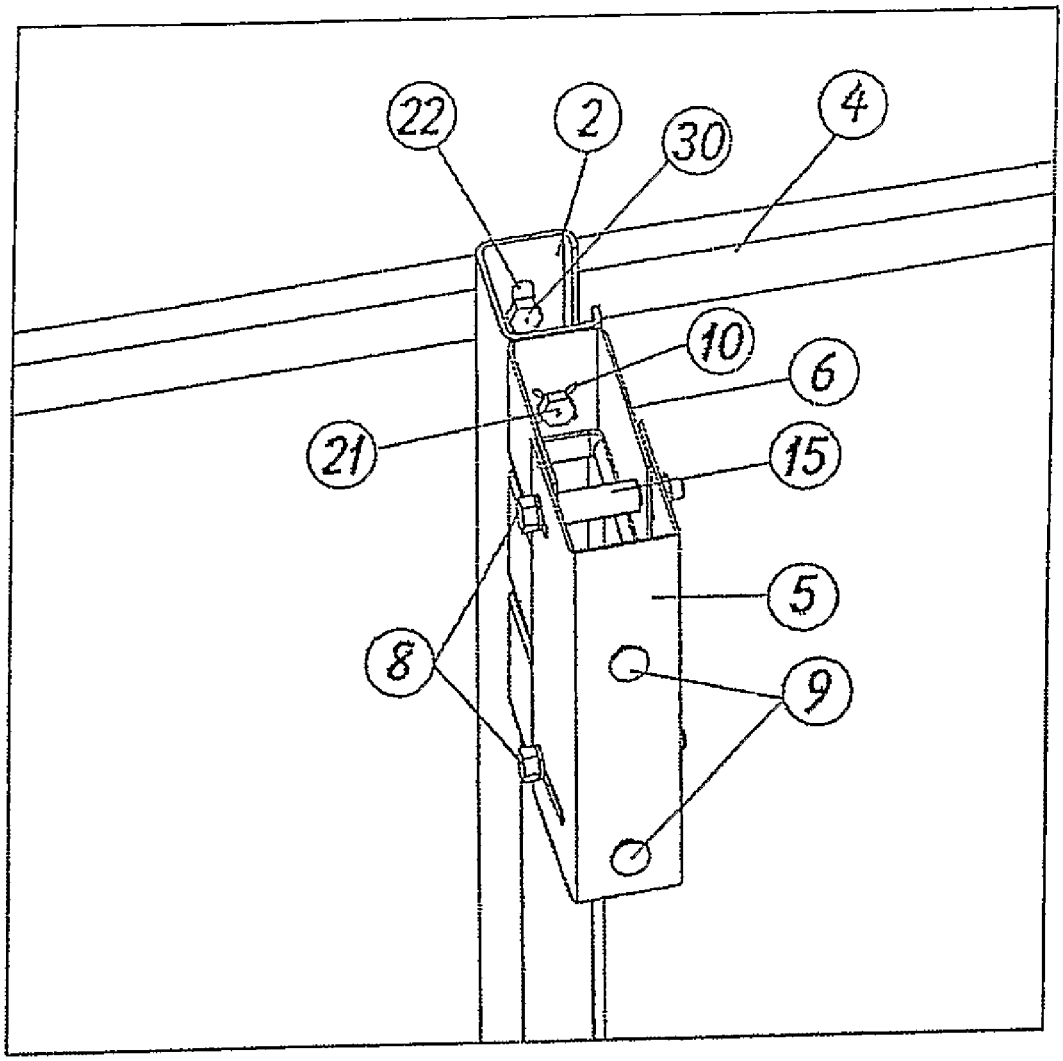
FIG. 11. Shows a perspective view of the separator unit fixed to the post without fences, or railings, nor any horizontal impact element.

FIGS. 1 to 12 show a particular embodiment of the present invention consisting of a deformable separator device (3) which is combined into a safety barrier comprised of one or several continuous horizontal fences or railings (1) and (1') or of any other horizontal impact element, supported via the separator (3) by vertical fastening elements or vertical posts (2) inserted into the ground (7) at regular intervals and a horizontal continuous rear brace (4) which is connected to the post (2) via its rear part.

The deformable separator (3) is basically composed of two metallic pieces (5) and (6), both with a U-shaped cross-section, each with a central face and two lateral faces parallel to each other and with a straight fold, sharp or with rounded edge, between the central face and each of the lateral faces, the relative position of the two U-shaped pieces (5) and (6) being such that the longitudinal axes of both are parallel or appreciably parallel to each other and are arranged vertically or with a slight inclination. The two U-shaped pieces are assembled to form a single body in such a way that the open parts or "throats" of each U-piece have different widths and are facing each other, with one U-piece remaining partially contained within the "throat" of the other U-piece, with the lateral faces of both pieces being very close to each other or in direct contact end to end two by two and the pieces being joined together by means of bolts (8) which successively traverse their lateral faces perpendicularly to their longitudinal axis.

One of the U-shaped pieces (5) is fixed, preferably by means of one or several bolts which traverse one or several holes (9) in its central face, which is what forms the core or "spine" of the piece, to the horizontal railing(s) or fence(s) (1) and (1') of the barrier and therefore occupies a forward position (relative to the direction of the traffic) in the separator (3). The other U-piece (6) is fixed, preferably by means of one or several bolts which traverse holes (10) in its central face, which is what forms the core or "spine" of the U-piece, to the post (2) of the safety barrier and therefore occupies a rear position in the separator (3).

Preferably, it is the "throat" of the forward U-piece (5) which externally embraces the "throat" of the rear U-piece (6).

The bolts (8) joining the two U-pieces (5) and (6) to each other do so by successively traversing holes (11), (11'), (12) and (12') made for the purpose in the lateral faces of the two U-pieces. The holes (11) and (11') which have been made for the purpose in both lateral faces of one of the U-pieces, preferably the one occupying the forward position (5), have a shape in the form of a grommet (11) and (11') with a rear cavity that is rounded or similar (13) and (13') of diameter or size greater than the diameter of the shaft of the bolt (8) and a forward elongated cavity (14) and (14') connected to the rear one (13) and (13') and of width less than the diameter of the shaft of the bolt (8), said cavity being able to be straight or curved and preferably with a straight section linked in the round cavity and a curved section forward of the straight section. Each lateral face of this forward U-piece (5) can have two or more holes in the form of a grommet (11) and (11') located at different heights. The length of the elongated cavity section is preferably greater to the degree that the hole corresponds to a lower position according to the vertical or slightly inclined longitudinal axis of the U-piece.

The holes (12) and (12') made in the lateral faces of the other U-shaped piece, preferably the rear one (6), have a circular or rounded shape of diameter greater than the diameter of the shaft of the union bolt.

The arrangement of the holes (11), (11'), (12) and (12') in each lateral face of the two U-pieces (5) and (6) is such that to each hole of one lateral face there corresponds another symmetric one according to the longitudinal axis of the U-piece located in the other lateral face thereof. The union between the two U-pieces made in this way permits them to be capable of being partially displaced one with respect to the other by translation in a vertical plane with one being maintained inside the other over the course of a certain distance and, thanks to the curved section of the forward section of the holes forming the grommets of the lateral faces of one of them, they are also capable of rotating one with respect to the other around the axis defined by the union bolts. The length of the curved section of the elongated cavity of the hole in the form of a grommet is greater to the degree that the position of the hole is lower according to the longitudinal axis of the U-piece, and this allows the angle of rotation of one piece with respect to the other to increase.

The fact that the width of the forward cavity (14) and (14') of the hole in the form of a grommet (11) and (11') of the forward U-piece (5) is less than the diameter of the shaft of the bolt (8) means that, during the relative displacement of one piece (6) within the other (5), the shaft of the bolt (8) deforms the walls of the elongated cavity (14) and (14') of the hole in the form of a grommet (11) and (11') and, with it, there appears a progressive resistance to the sliding of the shaft of the bolt (8) within the hole (11) and (11') which permits both the translation movement and the rotation of one U-piece (5) with respect to the other U-piece (6) to be controlled, with one U-piece (6) being maintained partially within the other U-piece (5).

In order to guarantee the rigidity of the set of two U-pieces (5) and (6) making up the separator (3) and, in turn, permit movement of one of them inside the other, tubes (15) are provided, preferably metallic and of circular cross-section, circumscribed around the shaft of each union bolt (8) between the U-pieces, "sheathing" it, the length of which is slightly less than the distance between the interior side walls of the U-piece (6) fixed to the post or the rear. These tubes (15) exert a separating function between the walls in the manner of the interior U-piece (6) which, once the union bolts (8) have been placed and tightened, maintains the interior distance between the lateral faces of the rear U-piece (6), making it possible so that, during the impact of the vehicles, said U-piece (6) behaves as a rigid body, resistant to deformation by twisting, as if it were a tube of rectangular cross-section.

Also with the aim of the rear U-piece (6) attached to the post (2) being more rigid and resistant to twisting relative to the vertical axis, one or more ribs (16) are provided, orientated preferably towards the interior of the U-piece (6) in a plane, preferably horizontal or slightly inclined, perpendicular to the longitudinal axis thereof, along the entire or a large part of the perimeter of the U-section of the rear piece (6).

In order to facilitate movement of one U-piece (5) with respect to the other (6) when the shaft of the bolt (8) is displaced via the hole in the form of a grommet (11) and (11'), washers (17) are provided, preferably circular, below the head (18) and the nut (19) of the bolt (8), in contact with the surface of both lateral faces of the forward U-piece (5), respectively.

An alternative design of the separator consists of replacing the rear U-piece (6) with a tube of quadrangular or rectangular cross-section (6') whose axis is vertical or slightly inclined, with everything described above being valid in relation to the holes for the lateral faces of the tube which would correspond to the lateral faces of the rear U-piece (6) and for the rear face of the tube which would correspond to the central face of the rear U-piece (6), as is that described for the mechanism enabling relative displacement between the forward U-piece (5) which, in this case, would embrace the rear tube (6') via its exterior part.

In its central face or core the rear U-piece (6) of the separator is provided with one or several holes (10) in order to permit its union with the post (2) of the barrier. Said unions are preferably of the screwed type, with bolts (20) of preferably hexagonal head (21), though it can also be quadrangular or round, the shaft of which passes successively through the corresponding hole (10) in the rear U-piece (6) and through the hole of the post (22), in such a way that the hexagonal head (22) of the screw remains inside the separator (3) and the corresponding nut (23) and washer (24) in the interior of the post (2). The holes (10) in the central face or "spine" of the rear U-piece (6) present a special contour in the form of a star made up of a central cavity (25), preferably circular or appreciably rounded, from which exit a series of elongated cavities (26) of small width (in other words, much longer than they are wide) and arranged in a radial configuration around the central cavity (25).

The diameter or size of the central cavity (25) of the star-shaped hole (10) is greater than the diameter of the shaft of the bolt (20) but less than the diameter or size of the head (21) of the bolt.

The combination of the use of the bolt (20) with preferably hexagonal head (21) and a star-shaped hole (10) in the central face of the rear U-piece (6) of the separator (3) enables a fusible union mechanism to be constructed between the separator (3) and post (2) by means of the bolt (20) which, once tightened, and starting from a certain degree of force acting on the union, permits separation of the separator (3) with respect to the post (2), thanks to the fact that the head (21) of the union bolt (20) can pass through the star-shaped hole (10), bending the metal walls located between the radii (the elongated narrow cavities) (26) of the star-shaped cavity. The result is similar to a tearing of the immediate surrounds of the star-shaped hole (10) produced by the head (21) or the bolt (20) until that head passes completely through the star-shaped hole and releases that union.

The invention claimed is:

1. A deformable separator device of the type used between a post and a railing of a road safety barrier comprising, a first metallic piece comprising a central face and two lateral faces parallel to each other and perpendicular to the central face, each of said lateral faces having an upper hole and a bottom hole, said central face having at least two holes in order to fasten said first metallic piece to said post with fastening bolts, and a second metallic piece comprising a central face slightly wider that the central face of the first metallic piece, and two lateral faces parallel to each other and perpendicular to the central face, each of said lateral faces having an upper guide-hole and a bottom guide-hole, said central face having at least two holes in order to fasten said second metallic piece to said railing with fastening bolts, wherein both metallic pieces are assembled facing each other in such a way that the first metallic piece is partially contained within the throat of the second metallic piece, both metallic pieces being joined together by means of bolts which traverse said holes and guide-holes.

2. A deformable separator device according to claim 1 wherein each hole in the central face of said first metallic piece comprises, a central rounded cavity of greater diameter than the shaft of said bolts which fasten the first metallic piece to the post, and of a smaller diameter than the head of said bolts which fasten the first metallic piece to the post, a set of elongated cavities of small width and arranged in a radial configuration around said central cavity in a star-shape configuration, and a small membrane which connects the central cavity and the elongated cavities.

3. A deformable separator device according to claim 1 or 2 wherein said upper guide-holes consist of a first rounded section of greater diameter than the diameter of the bolts which fasten the first and second metallic pieces, and a second slightly elongated extension which is appreciably narrower than the diameter of said bolts which fasten the first and second metallic pieces, and said bottom guide-holes consist of a first rounded section of greater diameter than the diameter of the bolts which fasten the first and second metallic pieces, and a second elongated and curved extension in the trajectory of the pivoted movement around the upper hole which is appreciably narrower than the diameter of said bolts which fasten the first and second metallic pieces.

4. A deformable separator device according to claim 1 or 2 wherein the union of both metallic pieces through the bolts incorporates sleeves sheathing the shaft of said bolts.

5. A deformable separator device according to claim 1 or 2 wherein each of said lateral faces of the first metallic piece comprises at least a longitudinal groove perpendicularly oriented toward the post.

6. A deformable separator according to claim 1 or 2 wherein both metallic pieces have a "U" shape cross section.

7. A deformable separator device according to claim 1 or 2 wherein thickness of the lateral faces and central face of the metallic pieces is notably small in comparison with their other dimensions.

8. A deformable separator device according to claim 1 or 2 wherein the value of the thickness of the lateral faces and central face of the metallic pieces lying between 0.5 mm and 10 mm.

9. A deformable separator device according to claim 1 or 2 wherein the holes in the central faces of both metallic pieces are vertically aligned, the first metallic piece is fastened to the post by means of bolts with a hexagonal head, and the second metallic piece is fastened to the railing by means of bolts with a circular head.

10. A deformable separator device according to claim 1 or 2 wherein said post has a open cross-section type and incorporates two U-shaped plates at a different height and both arranged in a plane that is vertical and parallel to the core of the post, joining the open side faces of the profile of the post, the upper plate being located close to the head of the post and in a position such that, once the post has been assembled with the separator, the lower edge of the upper plate is at the same height or above the lower edge of the separator and the lower plate is partially buried in the ground.

11. A deformable separator device according to claim 10 wherein the post incorporates a connection system in its upper part by means of braces of trapezoid profile.

* * * * *